US010711481B2

(12) United States Patent
Zhu et al.

(10) Patent No.: US 10,711,481 B2
(45) Date of Patent: Jul. 14, 2020

(54) REMOVABLE SUNSHADE BASE AND SUNSHADE

(71) Applicant: Zhejiang Yotrio Group Co., Ltd., Linhai (CN)

(72) Inventors: Lei Zhu, Linhai (CN); Jianqiang Xie, Linhai (CN)

(73) Assignee: ZHEJIANG YOTRIO GROUP CO., LTD., Linhai (CN)

( * ) Notice: Subject to any disclaimer, the term of this patent is extended or adjusted under 35 U.S.C. 154(b) by 0 days.

(21) Appl. No.: 16/115,547

(22) Filed: Aug. 28, 2018

(65) Prior Publication Data

US 2019/0376307 A1 Dec. 12, 2019

(30) Foreign Application Priority Data

Jun. 12, 2018 (CN) ..... 2018 2 0908966 U

(51) Int. Cl.
*E04H 12/22* (2006.01)
*A45B 23/00* (2006.01)

(52) U.S. Cl.
CPC ..... *E04H 12/2253* (2013.01); *A45B 23/00* (2013.01); *E04H 12/22* (2013.01); *E04H 12/2238* (2013.01); *A45B 2023/0006* (2013.01)

(58) Field of Classification Search
CPC . E04H 12/2253; E04H 12/22; E04H 12/2269; E04H 12/2238; E04H 12/2284; A45B 2023/0006; A45B 11/00; A45B 23/00; A45B 2023/0025; A47G 33/12; A47G 33/1226
USPC ..... 248/523, 346.01, 346.03, 519, 129, 128; 280/37
See application file for complete search history.

(56) References Cited

U.S. PATENT DOCUMENTS 165,965 A * 7/1875 West ..... B60B 33/06 280/43.14
3,141,680 A * 7/1964 McCord ..... A45C 5/146 280/38
4,995,487 A * 2/1991 Plath ..... A45C 5/00 190/108
5,464,080 A * 11/1995 Liang ..... A45C 13/262 190/115
6,279,705 B1 * 8/2001 Wu ..... A45C 5/14 190/115
6,302,250 B1 * 10/2001 Sadow ..... A45C 5/14 190/115
6,405,989 B2 * 6/2002 Davis ..... A63B 71/023 248/129

(Continued)

*Primary Examiner* — Nkeisha Smith
(74) *Attorney, Agent, or Firm* — Schwegman Lundberg & Woessner, P.A.

(57) ABSTRACT

This invention provides a removable sunshade base and a sunshade including the removable sunshade base. The removable sunshade base includes a sunshade base body and a pull rod. A bottom of the sunshade base body has a sliding groove and first sliding wheels. One end of the pull rod has a second sliding wheel, and the pull rod is movably connected with the sliding groove of the sunshade base body such that the pull rod is accommodated in the sliding groove or is pulled out from the sliding groove. When the pull rod is pulled out from the sliding groove, both the first sliding wheels and the second sliding wheel contact one supporting plane to move the sunshade base body.

18 Claims, 4 Drawing Sheets

(56) References Cited

U.S. PATENT DOCUMENTS

| | | | | |
|---|---|---|---|---|
| 6,656,065 | B2 * | 12/2003 | Nye | A63B 63/083 254/9 R |
| 7,431,259 | B2 * | 10/2008 | Tung | A45B 17/00 135/20.3 |
| 8,292,309 | B2 * | 10/2012 | Fan | B60B 37/10 280/43.14 |
| 8,919,361 | B2 * | 12/2014 | Ma | E04H 12/2238 135/16 |
| 8,960,625 | B2 * | 2/2015 | Ma | E04H 12/2238 248/129 |
| 9,192,266 | B2 * | 11/2015 | Starr | A47J 47/16 |
| 9,358,995 | B2 * | 6/2016 | Allos | B62B 3/008 |
| 10,100,969 | B1 * | 10/2018 | Zhu | E04H 12/2238 |
| 2002/0023813 | A1 * | 2/2002 | Tiramani | A45C 3/001 190/115 |
| 2007/0186827 | A1 * | 8/2007 | Loftus | B65D 19/0016 108/57.15 |
| 2013/0200246 | A1 * | 8/2013 | VanBenschoten | F16M 11/42 248/519 |
| 2017/0114563 | A1 * | 4/2017 | Ye | A45B 11/00 |

* cited by examiner

REMOVABLE SUNSHADE BASE AND SUNSHADE

CROSS-REFERENCE TO RELATED APPLICATIONS

This Non-provisional application claims priority under 35 U.S.C. § 119(a) on Chinese Patent Application No(s). 201820908966.9 filed on Jun. 12, 2018, the entire contents of which are hereby incorporated by reference.

BACKGROUND OF THE INVENTION

Field of the Invention

This invention relates to a sunshade base, and more particularly, to a removable sunshade base. In addition, this invention further provides a sunshade of the removable sunshade base.

Description of the Related Art

With continuous development of society, sunshade, which has a function of sheltering the sun and providing shade, has been widely used in a home, a swimming pool, a hotel, a guesthouse, and other entertainment places. The sunshade is usually supported by a sunshade base, and the weight of the sunshade base is an important factor to firmly support the sunshade body. It must be heavy enough to support the heavy sunshade body. Therefore, the sunshade is generally heavy and difficult to transport and move. If the position of the sunshade is going to be adjusted, it will take much time and effort, and sometimes it takes even a few people to work together to move sunshade.

BRIEF SUMMARY OF THE INVENTION

The objective of this invention is to provide a removable sunshade base and a sunshade, to solve the problem that the existing sunshade is not easy to move.

To solve the above-mentioned problems, this invention provides a removable sunshade base, and the removable sunshade base includes a sunshade base body and a pull rod. A bottom of the sunshade base body has a sliding groove and first sliding wheels. One end of the pull rod has a second sliding wheel, and the pull rod is movably connected with the sliding groove of the sunshade base body such that the pull rod is accommodated in the sliding groove or is pulled out from the sliding groove. When the pull rod is pulled out from the sliding groove, both the first sliding wheels and the second sliding wheel contact one supporting plane to move the sunshade base body.

According to an embodiment of the present invention, the bottom of the sunshade base body may have two first protruding platforms, and the two first protruding platforms may be disposed apart. When the pull rod is accommodated in the sliding groove, the two first protruding platforms and the first sliding wheels may support the sunshade base body.

According to an embodiment of the present invention, the bottom of the sunshade base body may have a clamping slot, the clamping slot may be located at one end of the sliding groove and may communicate with the sliding groove, one end of the pull rod may have a clamping tube, and the clamping tube and the second sliding wheel may be located at the same end of the pull rod. When the pull rod is pulled out from the sliding groove, the second sliding wheel may slide from one end of the sliding groove to the other end of the sliding groove, and the clamping tube may be clamped at the clamping slot, such that the pull rod is inclined upward and the second sliding wheel contact the supporting plane.

According to an embodiment of the present invention, the bottom of the sunshade base body may have a second protruding platform, and a side wall of the second protruding platforms may integrally extend from an inner wall of the clamping slot.

According to an embodiment of the present invention, the number of the first sliding wheels is two, and the two first sliding wheels may be disposed apart.

According to an embodiment of the present invention, a length of the pull rod may be changeable.

According to an embodiment of the present invention, the other end of the pull rod may have a handle.

According to an embodiment of the present invention, the sunshade base body may have a connection hole for fixing a sunshade rod.

According to another aspect of this invention, this invention further provides a sunshade, and the sunshade includes the removable sunshade base according to any of the above and a sunshade body. The sunshade body has a sunshade rod, and the sunshade body is detachably connected with the removable sunshade base through the sunshade rod.

According to an embodiment of the present invention, the sunshade base body may have a connection hole for fixing the sunshade rod, and the sunshade rod of the sunshade body may be inserted into the connection hole.

Compared with the prior art, this technical solution has the following advantages:

By disposing the pull rod and correspondingly disposing the sliding groove and the first sliding wheels at the bottom of the sunshade base body, the pull rod can be selectively accommodated at the bottom of the sunshade base body or be pulled out from the sliding groove at the bottom of the sunshade base. When the pull rod is pulled out from the sliding groove, the first sliding wheels and the second sliding wheel disposed at one end of the pull rod contact the support plane such that the user can pull the pull rod and move the sunshade base body through the first sliding wheels and the second sliding wheel. That is to say, the sunshade including the removable sunshade base can be moved on the supporting plane such as the ground. Compared with the traditional sunshade that cannot be moved, by adopting the technical solution of this invention, the user can move the sunshade with less time and effort. In addition, through a way of pulling the pull rod, operation is simple and convenient.

By disposing the clamping slot communicating with the sliding groove at the bottom of the sunshade base body, when the pull rod is pulled out from the sliding groove, the clamping tube at one end of the pull rod can just clamp at the clamping slot, such that not only the pull rod can be fixed with the sunshade base body, but also the pull rod can be inclined upwardly, i.e., the pull rod and the support plane form an angle of inclination. In this way, it is convenient for the user to pull the pull rod by hand, and the operation is convenient.

By disposing the second protruding platforms at the sunshade base body, it is further possible to limit the clamping tube when the pull rod is pulled out and is in an upwardly inclined state, which prevents the clamping tube of the pull rod from escaping from the clamping slot and causes the pull rod to be separated from the sunshade base body.

By disposing the pull rod with changeable length, the user can adjust the pull rod to an optimum length according to an actual situation, for example, according to different heights, which facilitates the operation.

This invention provides the connection hole for fixing the sunshade rod at the sunshade base body, the removable sunshade base can be detachably connected with the sunshade body, which reduces the occupying space of the sunshade, and is convenient for storage and transportation.

DETAILED DESCRIPTION OF THE INVENTION

Figure 1:
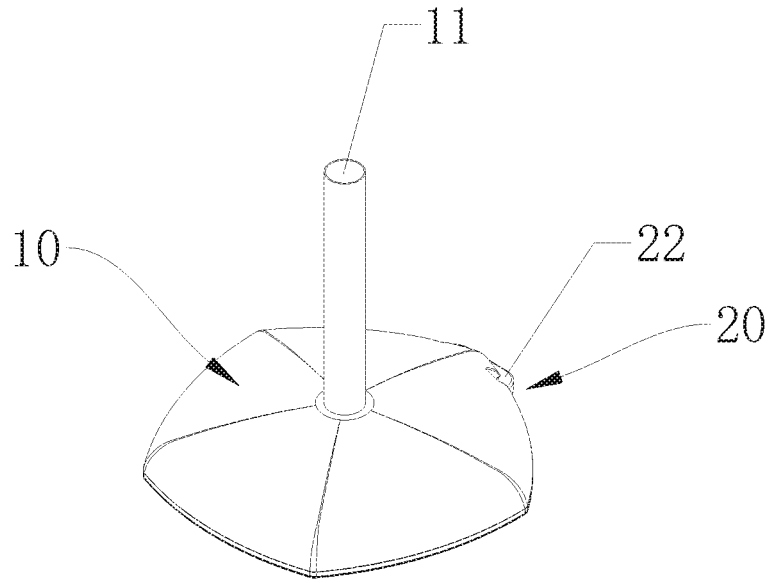
FIG. 1 is a three-dimensional structural diagram of a removable sunshade base according to an embodiment of this invention.
Figure 2:
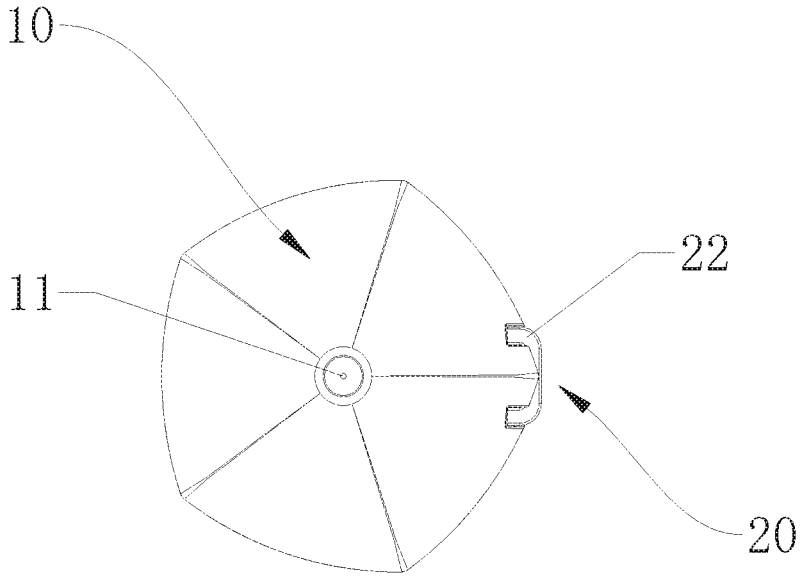
FIG. 2 is a top view of the removable sunshade base according to an embodiment of this invention.

The following description is only used to disclose the present invention so that those skilled in the art can implement the present invention. The following described embodiments are only examples, and those skilled in the art can think of other obvious variations. The basic principle of the present invention defined in the following description can be applied to other embodiments, variants, improvements, equivalents and other solutions without departing from the spirit and scope of the present invention.

As shown in FIG. 1 to FIG. 6, embodiments of this invention provides a removable sunshade base. In practical application, the removable sunshade base and a sunshade body are assembled to a sunshade, and the removable sunshade base supports the sunshade body of the sunshade. The removable sunshade base includes a sunshade base body 10 and a pull rod 20.

The top of the sunshade base body 10 has a connection hole 11 for fixing a sunshade rod of the sunshade body, and the bottom of the sunshade base body 10 has a sliding groove 12 and first sliding wheels 13. The connection hole 11 is located at the center of the top of the sunshade base body 10, such that the sunshade rod of the sunshade body can be inserted into the connection hole 11, that is, the sunshade body can be detachably connected with the removable sunshade base through the sunshade rod. One end of the sliding groove 12 has an opening, that is, one end of the sliding groove 12 is not closed. The number of the first sliding wheels 13 is two, and the two first sliding wheels 13 are disposed apart. In other embodiments, the number of the first sliding wheels 13 is other value, such as three or four, which is not limited by this invention.

Figure 3:
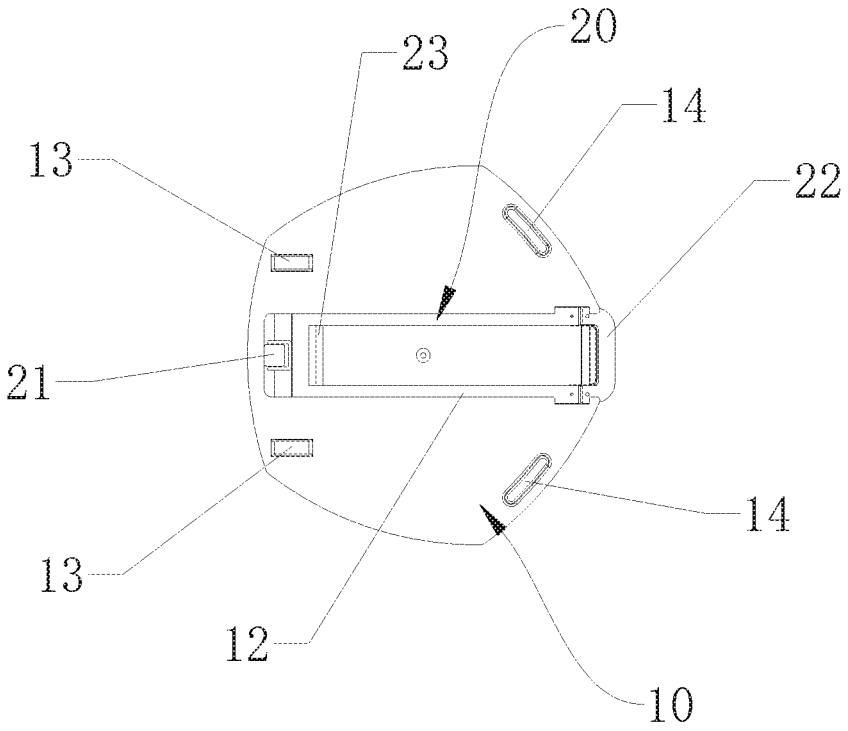
FIG. 3 is a bottom view of the removable sunshade base according to an embodiment of this invention.
Figure 4:
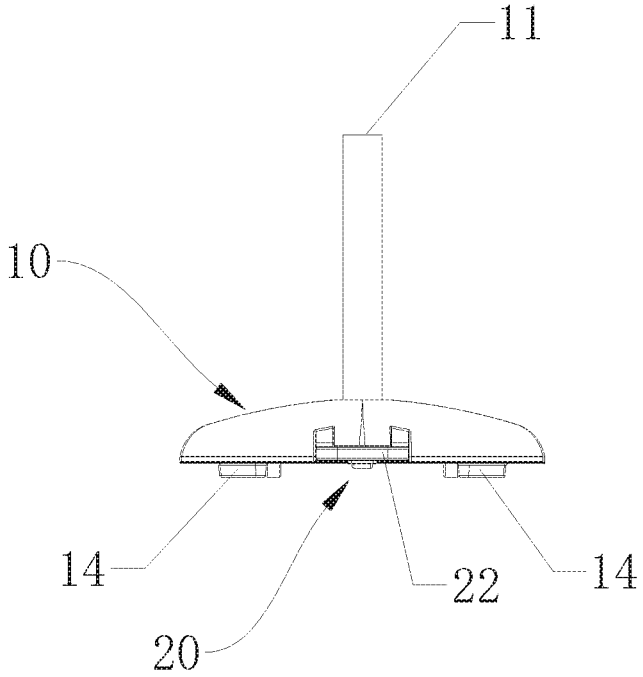
FIG. 4 is a side view of the removable sunshade base according to an embodiment of this invention.

The bottom of the sunshade base body 10 has two first protruding platforms 14, and the two first protruding platforms 14 are disposed apart. As shown in FIG. 3, the two first sliding wheels 13 and the two first protruding platforms 14 are distributed at four different positions at the bottom of the sunshade base body 10. When the removable sunshade base stands on the ground, both the two first sliding wheels 13 and the two first protruding platforms 14 contact a supporting plane such as the ground to support the removable sunshade base.

Figure 5:
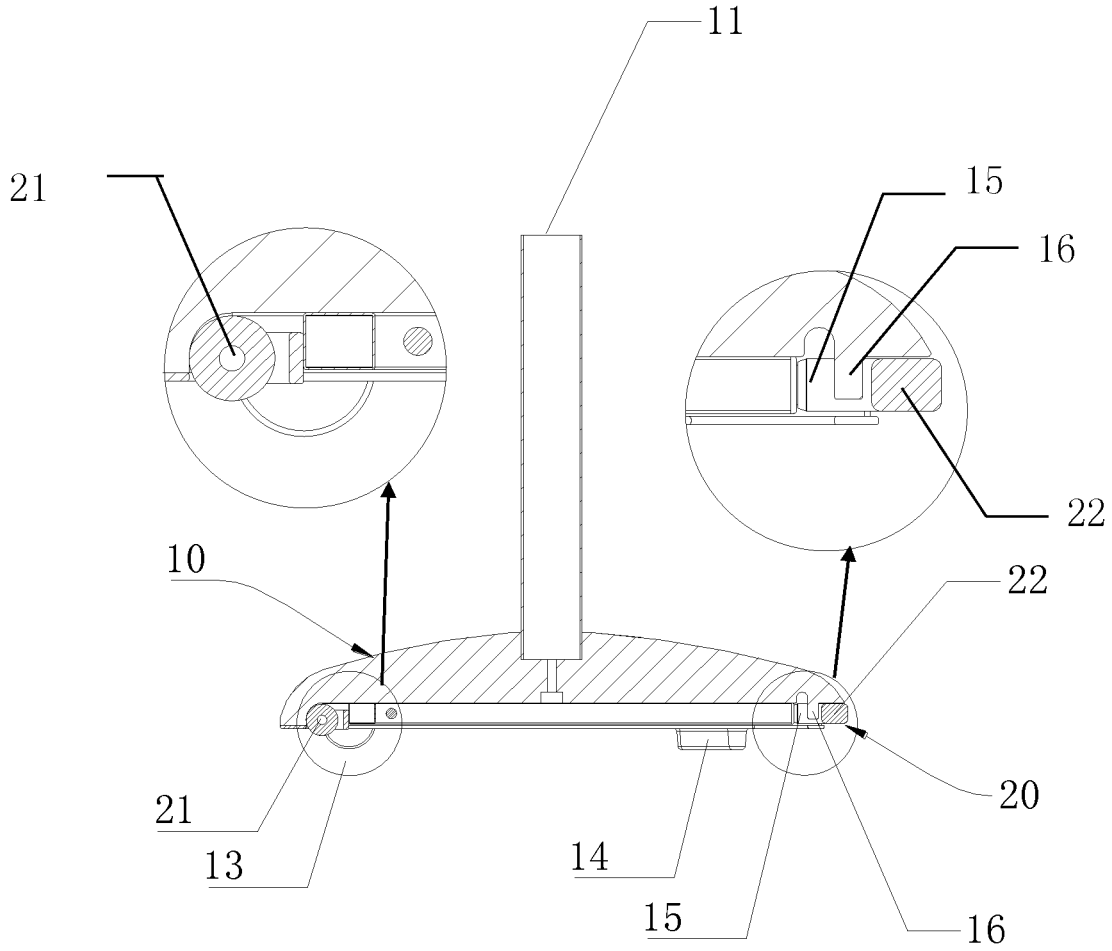
FIG. 5 is a section view of the removable sunshade base according to an embodiment of this invention.
Figure 6:
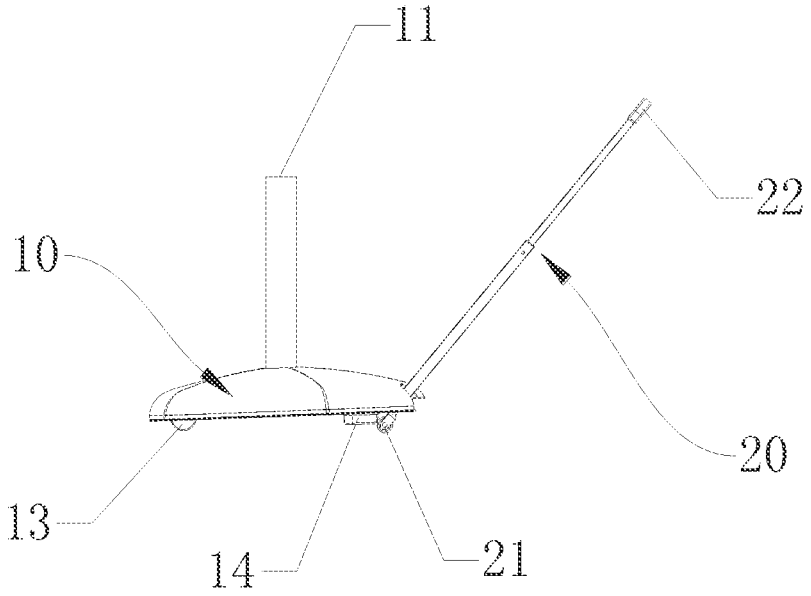
FIG. 6 is a side view of the removable sunshade base when a pull rod is pulled out according to an embodiment of the present invention.

The bottom of the sunshade base body 10 has a clamping slot 15, and the clamping slot is located at one end of the sliding groove 12 and is communicated with the sliding groove 12. Specifically, as shown in FIG. 5, the clamping slot 15 is located at one end of the sliding groove 12 having the opening, the clamping slot 15 is communicated with the sliding groove 12, and the clamping slot 15 is formed by further recessing from the inner wall of the sliding groove 12.

The bottom of the sunshade base body 10 has a second protruding platform 16, and the side wall of the second protruding platform 16 integrally extends from the inner wall of the clamping slot 15. Specifically, as shown in FIG. 5, the second protruding platform 16 is adjacent to the clamping slot 15, and the side wall of one side of the second protruding platform 16 and the inner wall of the clamping slot 15 are integrally formed.

The pull rod 20 is movably connected with the sunshade base body 10. One end of the pull rod 20 has a second sliding wheel 21, and the other end of the pull rod 20 has a handle 22. The handle 22 is used for a hand to pull the pull rod 20. Alternatively, the length of pull rod 20 is changeable. The pull rod 20 is movably connected with the sliding groove 12 of the sunshade base body 10 such that the pull rod 20 is accommodated in the sliding groove 12 or is pulled out from the sliding groove 12. That is to say, the pull rod 20 has two states. The pull rod 20 is operatively slid in the sliding groove 12, such that the pull rod 20 is pulled out from the sliding groove 12. At this time, one end of the pull rod 20 having a second sliding wheel 21 is still connected with the sunshade base body 10, and the other end of the pull rod 20 extends from the sunshade base body 10 for a user to pull the pull rod 20. Through this manner, the pull rod 20 is selectively accommodated in the sliding groove 12 or pulled out from the sliding groove 12.

When the pull rod 20 is accommodated in the sliding groove 12, the second sliding wheel 21 does not contact the supporting plane such as the ground. The two first protruding platforms 14 and the first sliding wheels 13 contact the supporting plane such as the ground, that is, the two first protruding platforms 14 and the first sliding wheels 13 support the sunshade base body 10.

When the pull rod 20 is pulled out from the sliding groove 12, both the first sliding wheels 13 and the second sliding wheel 21 contact the supporting plane to remove the sunshade base body 10.

Figure 7:
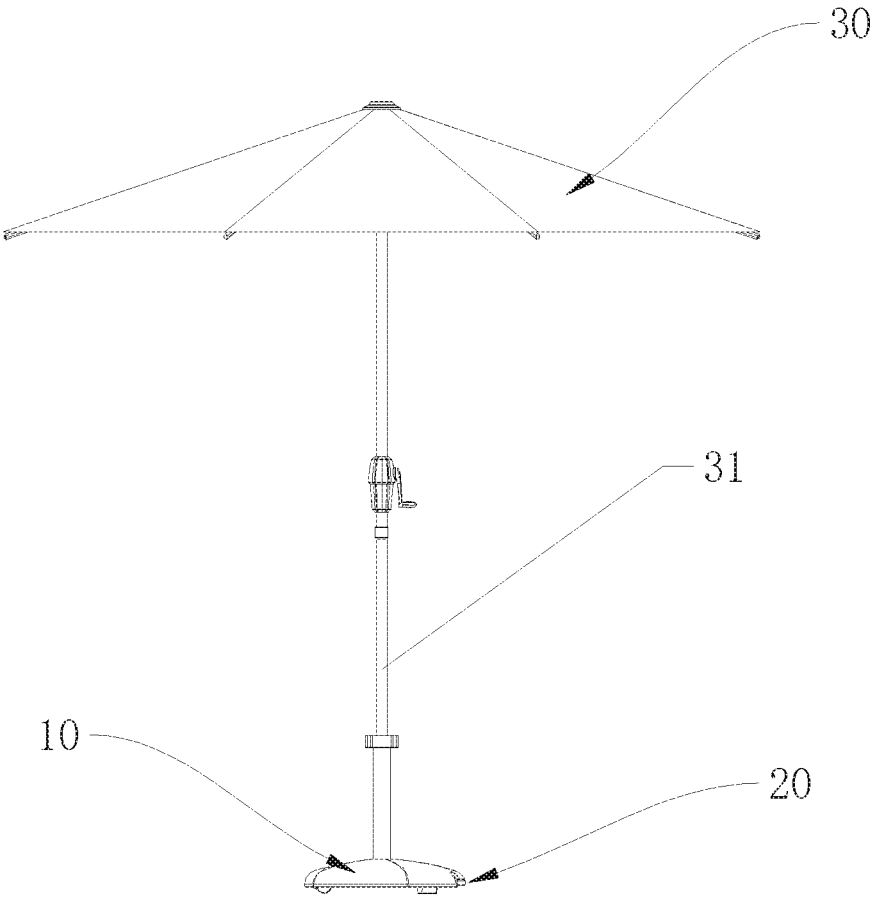
FIG. 7 is a structural diagram of a sunshade according to an embodiment of this invention.

Further, as shown in FIG. 3 and FIG. 7, one end of the pull rod 20 has a clamping tube 23. The clamping tube 23 is a small round tube, and the clamping tube 23 and the second sliding wheel 21 are located at the same end of the pull rod 20. When the pull rod 20 is pulled out from the sliding groove 12, the second sliding wheel 21 slides from one end of the sliding groove 12 to the other end of the sliding groove 12. The clamping tube 23 contacts the second protruding platform 16, and the pull rod 20 is raised such that the pull rod 20 is inclined upward. The clamping tube 23 is clamped at the clamping slot 15, and the second sliding wheel 21 contacts the supporting plane. In this way, the first sliding wheels 13 and the second sliding wheel 21 are all in contact with the supporting plane such as the ground, the user pulls the pull rod 20, and the sunshade base body 10 can move on the supporting plane. It can be understood that when the pull rod 20 is in an upwardly inclined state, that is, an inclined angle is formed between the pull rod 20 and the supporting plane, since the sunshade base body 10 is lifted slightly upward, the first protruding platforms 14 leave the supporting plane, and the second protruding platforms does not contact the supporting plane. At this time, the first sliding wheels 13 and the second sliding wheel 21 contact the supporting plane, the user holds the handle 22 to pull the pull rod 20, and sunshade base body 10 can be moved. In this way, the removable sunshade base together with the sunshade body can be easily moved to any target position.

According to another aspect of this invention, this invention also provides a sunshade including the removable sunshade base. As shown in FIG. 7, the sunshade includes a removable sunshade base and a sunshade body 30. The sunshade body 30 has a sunshade rod 31, and the sunshade body 30 is detachably connected with the removable sunshade base through the sunshade rod 31. Specifically, the sunshade base body 10 of the removable sunshade base has a connection hole 11 for fixing the sunshade rod, and the sunshade rod 31 of the sunshade body 30 can be inserted into the connection hole 11. In this way, the sunshade body 30 and the removable sunshade base are assembled into a sunshade, and the sunshade can be moved on a supporting plane such as the ground through the removable sunshade base.

Compared with the traditional sunshade that cannot be moved, by adopting the technical solution of this invention, the user can move the sunshade with less time and effort. The bottom of the sunshade base body is provided with the clamping slot which is communicated with the sliding groove, such that when the pull rod is pulled out from the sliding groove, the clamping tube at one end of the pull rod can just clamp at the clamping slot, so that not only the pull rod can be fixed with the sunshade base body, but also the pull rod can be inclined upwardly, i.e., the pull rod and the support plane form an angle of inclination. In this way, it is convenient for the user to pull the pull rod by hand, and the operation is convenient. The length of the pull rod is changeable, and the user can adjust the pull rod to an optimum length according to an actual situation, for example, according to different heights.

Although the present invention has been described in considerable detail with reference to certain preferred embodiments thereof, the disclosure is not for limiting the scope of the invention. Persons having ordinary skill in the art may make various modifications and changes without departing from the scope and spirit of the invention. Therefore, the scope of the appended claims should not be limited to the description of the preferred embodiments described above.

What is claimed is:

1. A removable sunshade base comprising:

a sunshade base body, having a bottom, the bottom having a sliding groove and first sliding wheels; and a pull rod, a first end of the pull rod having a second sliding wheel, wherein the pull rod is movably connected with the sliding groove of the sunshade base body such that the pull rod is capable of being accommodated in the sliding groove or pulled out from the sliding groove; and when the pull rod is pulled out from the sliding groove, both the first sliding wheels and the second sliding wheel contact one supporting plane to move the sunshade base body;

wherein the bottom of the sunshade base body has two first protruding platforms, the two first protruding platforms are disposed apart, when the pull rod is accommodated in the sliding groove, the two first protruding platforms and the first sliding wheels support the sunshade base body.

2. The removable sunshade base according to claim 1, wherein the bottom of the sunshade base body has a clamping slot, the clamping slot is located at one end of the sliding groove and is communicated with the sliding groove, the first end of the pull rod has a clamping tube, the clamping tube and the second sliding wheel are located at a same end of the pull rod, and when the pull rod is pulled out from the sliding groove, the second sliding wheel slides from one end of the sliding groove to an other end of the sliding groove, and the clamping tube is clamped at the clamping slot, such that the pull rod is inclined upward and the second sliding wheel contacts the supporting plane.

3. The removable sunshade base according to claim 2, wherein the bottom of the sunshade base body has a second protruding platform, and a side wall of the second protruding platforms integrally extends from an inner wall of the clamping slot.

4. The removable sunshade base according to claim 1, wherein a number of the first sliding wheels is two, and the two first sliding wheels are disposed apart.

5. The removable sunshade base according to claim 1, wherein a length of the pull rod is changeable.

6. The removable sunshade base according to claim 1, wherein a second end of the pull rod has a handle.

7. The removable sunshade base according to claim 1, wherein the sunshade base body has a connection hole for fixing a sunshade rod.

8. A sunshade, comprising:

a removable sunshade base comprising a sunshade base body, having a bottom, the bottom having a sliding groove and first sliding wheels; and a pull rod, the first end of the pull rod having a second sliding wheel, wherein the pull rod is movably connected with the sliding groove of the sunshade base body such that the pull rod is capable of being accommodated in the sliding groove or pulled out from the sliding groove; and when the pull rod is pulled out from the sliding groove, both the first sliding wheels and the second sliding wheel contact one supporting plane to move the sunshade base body;

wherein the bottom of the sunshade base body has two first protruding platforms, the two first protruding platforms are disposed apart, when the pull rod is accommodated in the sliding groove, the two first protruding platforms and the first sliding wheels support the sunshade base body; and a sunshade body having a sunshade rod, wherein the sunshade body is detachably connected with the removable sunshade base through the sunshade rod.

9. The sunshade according to claim 8, wherein the sunshade base body has a connection hole for fixing the sunshade rod, and the sunshade rod of the sunshade body is inserted into the connection hole.

10. The sunshade according to claim 8, wherein the bottom of the sunshade base body has a clamping slot, the clamping slot is located at one end of the sliding groove and is communicated with the sliding groove, the first end of the pull rod has a clamping tube, the clamping tube and the second sliding wheel are located at a same end of the pull rod, and when the pull rod is pulled out from the sliding groove, the second sliding wheel slides from one end of the sliding groove to an other end of the sliding groove, and the clamping tube is clamped at the clamping slot, such that the pull rod is inclined upward and the second sliding wheel contacts the supporting plane.

11. The sunshade according to claim 10, wherein the bottom of the sunshade base body has a second protruding platform, and a side wall of the second protruding platform integrally extends from an inner wall of the clamping slot.

12. The sunshade according to claim 11, wherein the sunshade base body has a connection hole for fixing the sunshade rod, and the sunshade rod of the sunshade body is inserted into the connection hole.

13. The sunshade according to claim 10, wherein the sunshade base body has a connection hole for fixing the sunshade rod, and the sunshade rod of the sunshade body is inserted into the connection hole.

14. The sunshade according to claim 8, wherein a number of the first sliding wheels is two, and the two first sliding wheels are disposed apart.

15. The sunshade according to claim 14, wherein the sunshade base body has a connection hole for fixing the sunshade rod, and the sunshade rod of the sunshade body is inserted into the connection hole.

16. The sunshade according to claim 8, wherein a length of the pull rod is changeable.

17. The sunshade according to claim 8, wherein a second end of the pull rod has a handle.

18. A removable sunshade base comprising:

a sunshade base body, having a bottom, the bottom having a sliding groove and first sliding wheels; and a pull rod, a first end of the pull rod having a second sliding wheel, wherein the pull rod is movably connected with the sliding groove of the sunshade base body such that the pull rod is capable of being accommodated in the sliding groove or pulled out from the sliding groove; and when the pull rod is pulled out from the sliding groove, both the first sliding wheels and the second sliding wheel contact one supporting plane to move the sunshade base body;

wherein the bottom of the sunshade base body has a clamping slot, the clamping slot is located at one end of the sliding groove and is communicated with the sliding groove, the first end of the pull rod has a clamping tube, the clamping tube and the second sliding wheel are located at a same end of the pull rod, and when the pull rod is pulled out from the sliding groove, the second sliding wheel slides from one end of the sliding groove to an other end of the sliding groove, and the clamping tube is clamped at the clamping slot, such that the pull rod is inclined upward and the second sliding wheel contacts the supporting plane.

* * * * *